US007536840B2

(12) United States Patent
Ours et al.

(10) Patent No.: US 7,536,840 B2
(45) Date of Patent: May 26, 2009

(54) STACKABLE BULK TRANSPORT CONTAINER

(75) Inventors: David C. Ours, Marshall, MI (US); Randall L. Cary, Battle Creek, MI (US); Gary W. Gunia, Portage, MI (US)

(73) Assignee: Kellogg Company, Battle Creek, MI (US)

( * ) Notice: Subject to any disclaimer, the term of this patent is extended or adjusted under 35 U.S.C. 154(b) by 549 days.

(21) Appl. No.: 11/355,933

(22) Filed: Feb. 16, 2006

(65) Prior Publication Data

US 2006/0185327 A1 Aug. 24, 2006

Related U.S. Application Data

(60) Provisional application No. 60/654,436, filed on Feb. 18, 2005.

(51) Int. Cl.
*B65B 41/18* (2006.01)

(52) U.S. Cl. ..... 53/449; 53/173; 53/399

(58) Field of Classification Search ..... 53/173, 53/399, 447, 449, 540
See application file for complete search history.

(56) References Cited

U.S. PATENT DOCUMENTS

| | | | |
|---|---|---|---|
| 2,765,816 | A | 10/1956 | Carter |
| 3,374,599 | A | 3/1968 | Sanders |
| 3,570,749 | A | 3/1971 | Sato et al. |
| 3,778,962 | A | 12/1973 | James |
| 3,785,410 | A | 1/1974 | Carter |
| 3,906,591 | A | 9/1975 | Boiardi |
| 3,928,940 | A | 12/1975 | Fagniart |
| 3,943,988 | A | 3/1976 | Consorti |
| 3,949,536 | A | 4/1976 | Chevalier |
| 3,968,626 | A | 7/1976 | Hobbs |
| 4,074,507 | A | 2/1978 | Ruf et al. |
| 4,101,292 | A | 7/1978 | Hogan, II |
| 4,113,146 | A | 9/1978 | Williamson |
| 4,136,501 | A | 1/1979 | Connolly |
| 4,219,054 | A | 8/1980 | Carter et al. |
| 4,223,061 | A | 9/1980 | Michaels |
| 4,249,839 | A | 2/1981 | Vance |
| 4,253,507 | A | 3/1981 | Williamson |
| 4,299,076 | A | 11/1981 | Humphrey |
| 4,339,040 | A | 7/1982 | Peil et al. |
| 4,360,996 | A | 11/1982 | Rutter |

(Continued)

FOREIGN PATENT DOCUMENTS

| | | | |
|---|---|---|---|
| EP | 0122864 | A1 | 10/1984 |

*Primary Examiner*—Thanh K Truong
(74) *Attorney, Agent, or Firm*—Dickinson Wright PLLC

(57) ABSTRACT

The invention provides a stackable bulk transport container. The stackable bulk transport container includes a first bulk container that includes a flexible container filled with particulate material and wrapped in stretch wrap. The flexible container of the first bulk container is wrapped such that the stretch wrap is applied substantially at the fill level as the fill level rises. The stackable bulk transport container also includes a planar member positioned on the first bulk container. The planar member defines a substantially planar surface that engages the first bulk container. The stackable bulk transport container also includes a second bulk container positioned on the planar member. When the second bulk container is positioned on the planar member, the planar member flattens and expands the top portion of the first bulk container to enhance the stability of the stackable bulk transport container.

7 Claims, 2 Drawing Sheets

U.S. PATENT DOCUMENTS 4,409,776 A 10/1983 Usui
4,500,001 A 2/1985 Daniels
4,546,593 A 10/1985 Lasscock
4,648,432 A 3/1987 Mechalas
4,671,043 A 6/1987 Forni et al.
4,706,441 A 11/1987 Chervalier
4,734,292 A 3/1988 Gerardus Van Boxtel
4,753,060 A 6/1988 Furukawa
4,781,475 A 11/1988 LaFleur
5,016,761 A * 5/1991 Stoddard et al. ..... 211/59.4
5,025,925 A 6/1991 Wiklund
5,353,936 A 10/1994 Dockstader et al.
5,354,569 A 10/1994 Brown et al.
5,501,254 A 3/1996 Bjorklund
5,507,859 A 4/1996 Kaiser
5,544,472 A 8/1996 Koskinen et al.
5,566,530 A 10/1996 Johnstone et al.
5,567,048 A 10/1996 Hammonds
5,573,044 A 11/1996 Mechalas
5,598,684 A 2/1997 Aarts
5,678,387 A 10/1997 Aarts
5,687,551 A 11/1997 Mustain et al.
5,787,945 A 8/1998 Riemersma
5,809,744 A 9/1998 Villines et al.
5,887,409 A 3/1999 Leal Pereira Da Silva
5,953,888 A * 9/1999 Martin-Cocher et al. ..... 53/556
5,967,579 A 10/1999 Hebert
6,012,266 A 1/2000 Koskinen et al.
6,131,766 A 10/2000 King et al.
6,138,723 A 10/2000 Wagner
6,164,453 A * 12/2000 Perkins ..... 206/596
6,205,750 B1 3/2001 Koskinen et al.
6,299,354 B2 * 10/2001 Nickell et al. ..... 383/119
6,324,818 B1 12/2001 Morness et al.
6,343,459 B1 2/2002 Seaward et al.
6,415,927 B1 * 7/2002 Stone et al. ..... 206/600
6,494,324 B2 12/2002 Ours et al.
6,560,947 B2 * 5/2003 Kasel ..... 53/399
6,575,629 B1 * 6/2003 Perkins ..... 383/105
6,594,970 B1 7/2003 Hyne et al.
2001/0008567 A1 7/2001 Burkhardt
2002/0191869 A1 12/2002 Stewart et al.

* cited by examiner

STACKABLE BULK TRANSPORT CONTAINER

CROSS-REFERENCE TO RELATED APPLICATIONS

This application claims the benefit of U.S. Provisional Patent Application Ser. No. 60/654,436 for a STACKABLE BULK TRANSPORT CONTAINER, filed on Feb. 18, 2005, which is hereby incorporated by reference in its entirety.

BACKGROUND OF THE INVENTION

1. Field of the Invention

The invention relates to a method and apparatus for packaging particulate material.

2. Description of the Related Art

Articles can be contained and transported in flexible containers such as bags. It can be desirable to limit the movement of individual articles in the flexible container with respect to one another to reduce the likelihood that articles will be damaged and to increase the likelihood that the container will maintain a relatively rigid shape. Several different methods have been proposed to limit the movement of individual articles in the flexible container with respect to one another. For example, it is known to fill a flexible container and shrink-wrap the filled container. It is known to draw air from the flexible container to define a vacuum, wherein the vacuum seal can substantially limit the movement of articles in the container with respect to one another. It also is known to compress a filled, flexible container with pressurized air to urge air from the flexible container and substantially limit movement of articles in the container with respect to one another.

SUMMARY OF THE INVENTION AND ADVANTAGES

The invention provides a stackable bulk transport container. The stackable bulk transport container includes a first bulk container that includes a flexible container filled with particulate material and wrapped in stretch wrap. The flexible container of the first bulk container is wrapped such that the stretch wrap is applied substantially at the fill level as the fill level rises. The stackable bulk transport container also includes a planar member positioned on the first bulk container. The planar member defines a substantially planar surface that engages the first bulk container. The stackable bulk transport container also includes a second bulk container positioned on the planar member. When the second bulk container is positioned on the planar member, the planar member flattens and expands the top portion of the first bulk container to enhance the stability of the stackable bulk transport container.

Other embodiments of the present invention and applications for the exemplary embodiment of the invention will become apparent to those skilled in the art when the following description of the best mode contemplated for practicing the invention is read in conjunction with the accompanying drawings.

DETAILED DESCRIPTION OF A PREFERRED EMBODIMENT

Figure 1:
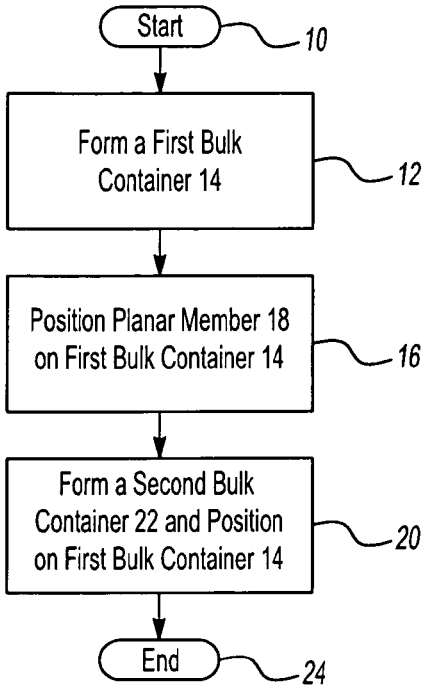
FIG. 1 is a simplified flow diagram illustrating the steps performed in the exemplary embodiment of the invention.

A plurality of different embodiments of the invention are shown in the Figures of the application. Similar features are shown in the various embodiments of the invention. Similar features have been numbered with a common reference numeral and have been differentiated by an alphabetic designation. Also, to enhance consistency, features in any particular drawing share the same alphabetic designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

This application incorporates U.S. Pat. No. 6,494,324 by reference. The '324 patent discloses transportable container and a method for forming the container. The present application discloses a method of stacking two containers formed by the method disclosed in the '324 patent to form the stackable bulk transport container. Also, the present application discloses variations to the method disclosed in the '324 patent to enhance stacking.

FIG. 1 is a simplified flow diagram of the exemplary embodiment of the inventive method. The process starts at step 10. At step 12, a first bulk container 14 is formed according to the methods disclosed in the '324 patent. Alternatively, the first bulk container 14 can be processed according to one or more of the disclosures of U.S. Pat. Nos. 6,892,768; 6,918,225; 6,935,385; and 6,945,015, as well as application Ser. No. 10/280,969, which are hereby incorporated by reference.

Figure 2:
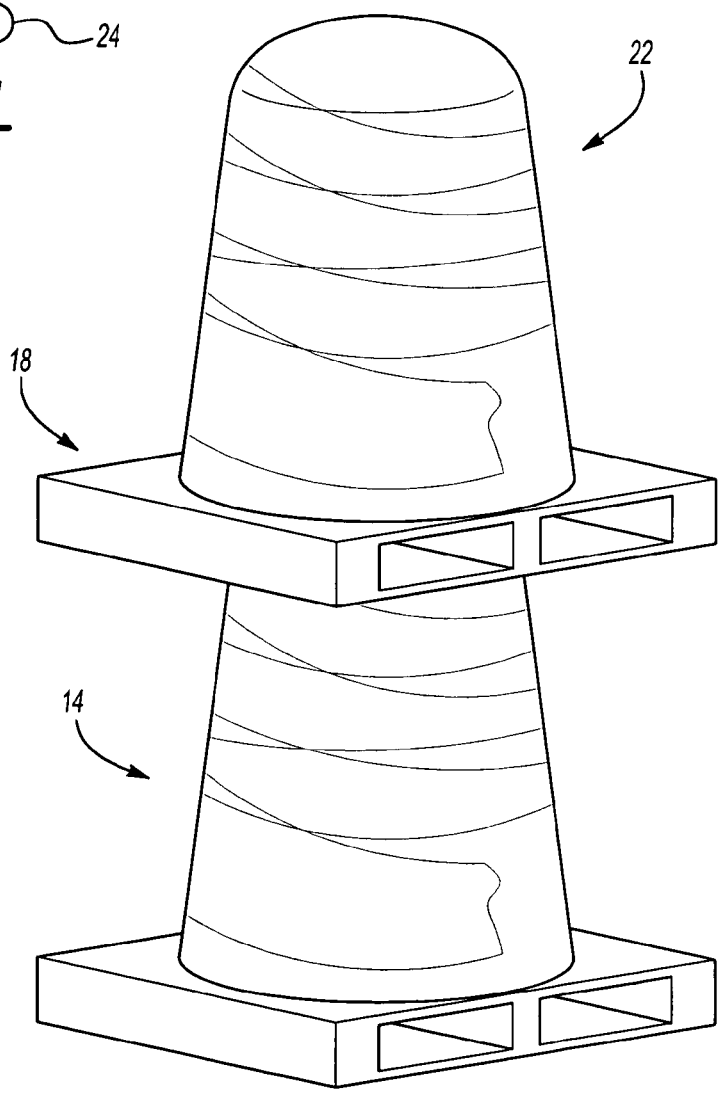
FIG. 2 is a front view of the stackable bulk transport container having first and second bulk containers stacked relative to one another.
Figure 3:
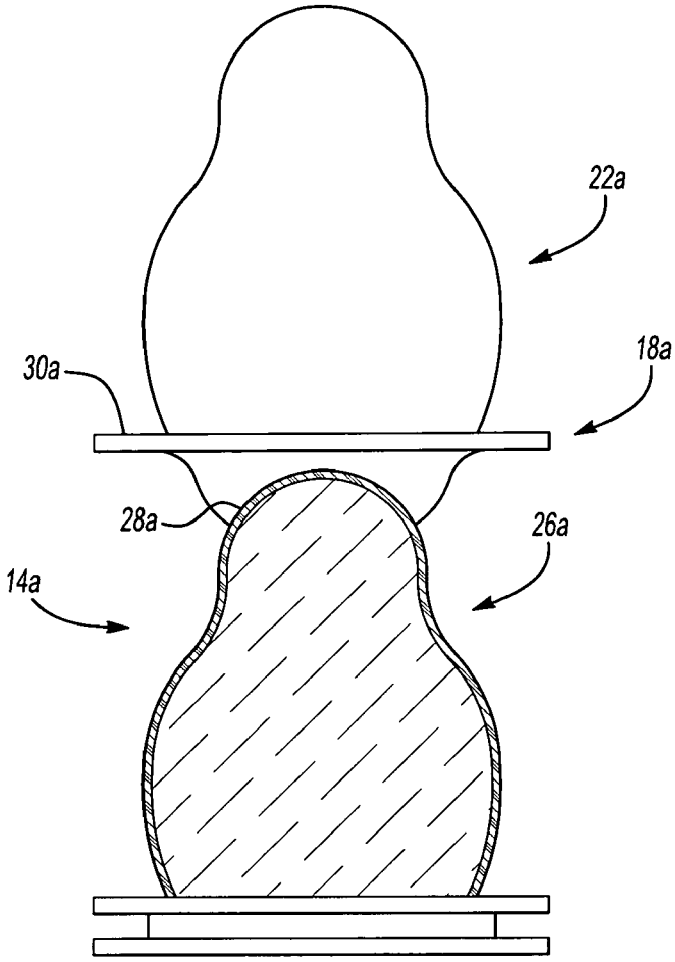
FIG. 3 is a partial cross-sectional view of a bulk transport container according to a second alternative embodiment of the invention.

The first bulk container 14 is shown in FIG. 2. In alternative embodiments of the invention, the methods disclosed in the '324 patent can be modified to increase a flatness of the top of the first bulk container 14. For example, FIG. 3 shows a first bulk container 14*a* formed such that the stretch wrap disposed adjacent to a top 26*a* of the first bulk container 14*a* generates relatively less hoop forces. Reduced hoop forces accommodate radially expansion of the top of the flexible container, as will be described in greater detail below. This effect is shown by the substantially cylidrical configuration of the top 26*a*. Alternatively, the particulate material at the top of the flexible container can be raked or spread prior to the top of the flexible container being folded over and wrapped with stretch wrap. Alternatively, the particulate material can be directed into the flexible container with a dispenser enhancing dispersion of the particulate material about the circumference of the flexible container, such as a Chinese hat.

The process moves from step 12 to step 16 and a substantially planar member 18 is positioned on top of the first bulk container 14. The substantially planar member 18 defines a substantially planar surface facing the first bulk container 14. In the exemplary embodiment of the invention shown in FIG. 2, the substantially planar member 18 is a common pallet disposed upside-down. The common pallet is disposed upside-down because numerous runners extend along a "top" surface, whereas only four runners extend along the bottom surface. The substantially planar surface of the substantially planar member 18 may have gaps; however, fewer and smaller gaps are preferred. If the pallet has numerous runners on both and top and bottom surfaces, the pallet may be placed with either side facing the first bulk container 14. In alternative embodiments of the invention, the substantially planar member 18 can be a slip sheet or may have a honey-comb planar cross-section. The planar member 18 can be corrugated, press-wood, or chip board. The planar member can be a plastic sheet or any combination the structures set forth above.

FIG. 3 shows an alternative embodiment of the invention wherein a substantially planar member 18*a* defines a receiving surface 28*a* shaped to correspond to the shape of the top 26*a* of the first bulk container 14*a*. The cooperation between the receiving surface 28*a* and the top 26*a* of the first bulk container 14*a* can enhance the stability of the stackable bulk container formed by the first and second bulk containers 14*a*, 22*a*. The exemplary substantially planar member 18*a* also includes a flat planar surface 30*a* to receive the second bulk container 22*a*.

Figure 4:
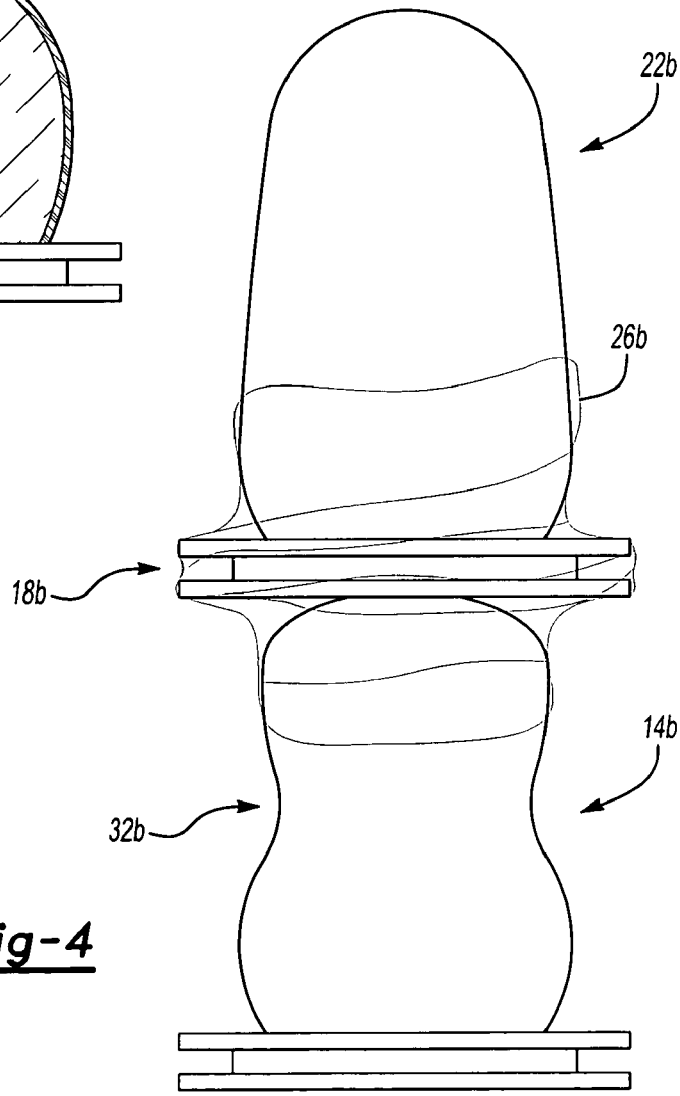
FIG. 4 is a front view of a bulk transport container according to a third embodiment of the invention.

The substantially planar member 18 can be wrapped with the flexible container of the first bulk container 14 at the end of formation of the first bulk container 14. Alternatively, the substantially planar member 18 can be wrapped with the first bulk container 14. FIG. 4 shows an alternative embodiment of the invention wherein a first bulk container 14*b* is wrapped with a substantially planar member 18*a* and with a second bulk container 22*b*, with wrap 26*b*.

The process moves from step 16 to step 20 and a second bulk container 22 is formed and positioned on the substantially planar member 18. The second bulk container 22 is formed according to the methods disclosed in the '324 patent. However, the second bulk container 22 can be formed according to the variations to the '324 patent set forth above, or other variations. The first and second bulk containers 14, 22 can be similarly formed to simplify and make consistent forming operations. The weight of the second bulk container 22 compresses the first bulk container 14 such that at least the top portion of the first bulk container 14, such as a truncated-conical top, is flattened.

The particulate material at the top portion of the first bulk container 14 moves radially outwardly and downwardly in response to positioning of the second bulk container 22 until forces are balanced. For example, the weight of the second bulk container 22 is balanced by other forces acting on the particulate material at the top portion of the first bulk container 14. For example, hoop forces applied by the stretch wrap squeeze the particulate material such that individual particles are gentled urged together to form a lattice structure within the flexible container. Also, frictional forces are generated between particles and resist radially outward movement and downward movement.

The properties of the particulate material and the force applied with the stretch wrap can be manipulated to enhance the stability of the stacked first and second bulk containers 14, 22. Generally, the strength of the hoop forces applied by the stretch wrap does not prevent the particulate material from moving downward and radially outward when the second bulk container 22 is initially positioned.

The static, or equilibrium, forces associated with the top of the first bulk container 14 include the weight of the second bulk container 22, the hoop forces generated by the stretch wrap, and frictional forces being generated between the individual particles of the particulate material. After the second bulk container 22 has stabilized on the first bulk container 14, any new force introduced to the system tending to move the second bulk container 22 relative to the first bulk container 14 is met with a broad area of resistance such that relatively small motion is met with a relatively large increase in force resisting movement.

The strength of the hoop forces can be selected in view of the frictional characteristics of the particulate material. For example, if the friction characteristics of the particulate matter of the first bulk container 14 are relatively low, relatively higher hoop forces can be generated by the stretch wrap. Similarly, if the friction characteristics of the particulate matter of the first bulk container 14 are relatively high, relatively lower hoop forces can be generated by the stretch wrap.

In alternative embodiments of the invention, the methods disclosed in the '324 patent can be modified to form the first bulk container 14 in an hourglass or hourglass-like shape, as shown in FIG. 4. Wrapping of the flexible container for forming the first bulk container 14*b* can be controlled to form a neck portion 32*b* at a midpoint of the flexible container, for example, or another position along the flexible container such as two-thirds of the height of the flexible container. Forming the first bulk container 14*b* in an hourglass or hourglass-like shape can increase the likelihood that the top portion of the first bulk container will define a relatively large, flat surface for receiving the substantially planar member 18*b*.

After step 20, the stacked first and second bulk containers 14, 22 may or may not be wrapped together. The process ends at step 24. In one example of the exemplary embodiment of the invention, a first bulk container 14 stood seventy-one inches tall before stacking and sixty-eight inches tall after stacking. The circumference of the first bulk container 14 increased by eight inches. The increase in circumference would result in an increase in the hoop force generated by the stretch wrap, the increase in hoop force corresponding to the weight of the second bulk container 22.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method for packaging a plurality of particles comprising the steps of:

filling a first radially flexible bulk container having a first large diameter with a plurality of particles to a first fill level;

applying a stretch wrap to the first radially flexible bulk container to reduce the first large diameter of the first radially flexible bulk container to a smaller first fill diameter in vertical relationship to the first fill level as the first fill level rises during filling of the first flexible container to generate hoop forces;

positioning a substantially planar member on top of the filled first radially flexible bulk container;

filling a second radially flexible bulk container having a second large diameter with a plurality of particles to a second fill level;

applying a stretch wrap to the second radially flexible bulk container to reduce the second large diameter of the second radially flexible bulk container to a smaller second fill diameter in vertical relationship to the second fill level as the second fill level rises during filling of the second flexible container to generate hoop forces;

positioning the filled second radially flexible bulk container on the substantially planar member and on top of the filled first radially flexible bulk container.

2. The method of claim 1 wherein said reducing the first large diameter step further comprises the step of:

generating less hoop forces at a top of the first radially flexible bulk container relative to the bottom of the first radially flexible bulk container to accommodate radial expansion of the top of the first radially flexible bulk container.

3. The method of claim 1 further comprising the step of:

spreading the plurality of particles at a top of the first radially flexible bulk container to accommodate the substantially planar member.

4. The method of claim 1 further comprising the step of:

directing the plurality of particles into the first radially flexible bulk container to enhance dispersion of the plurality of particles about a circumference of the first radially flexible bulk container.

5. The method of claim 1 further comprising the step of:

selecting a strength of the hoop forces in view of frictional characteristics of the plurality of particles.

6. The method of claim 1 wherein said reducing the first large diameter includes the step of:

forming a neck portion at a midpoint of the first radially flexible bulk container to increase the likelihood that the top portion of the first radially flexible bulk container will define a relatively large flat surface for receiving the substantially planar member.

7. The method of claim 1 further comprising the step of:

wrapping the first radially flexible bulk container and the second radially flexible bulk container together.

* * * * *